US008805243B2

(12) United States Patent
Fujiwara et al.

(10) Patent No.: US 8,805,243 B2
(45) Date of Patent: Aug. 12, 2014

(54) IMAGE FORMING APPARATUS

(75) Inventors: Takashi Fujiwara, Toyohashi (JP); Shoichi Yoshikawa, Okazaki (JP); Tadayasu Sekioka, Toyohashi (JP); Noboru Oomoto, Toyokawa (JP); Yoshiyuki Toso, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 243 days.

(21) Appl. No.: 13/324,508

(22) Filed: Dec. 13, 2011

(65) Prior Publication Data

US 2012/0155921 A1 Jun. 21, 2012

(30) Foreign Application Priority Data

Dec. 17, 2010 (JP) ..... 2010-281646

(51) Int. Cl.
*G03G 15/00* (2006.01)

(52) U.S. Cl.
USPC ..... 399/167

(58) Field of Classification Search
USPC ..... 399/116, 117, 167
See application file for complete search history.

(56) References Cited

U.S. PATENT DOCUMENTS 5,303,004 A * 4/1994 Maruyama et al. ..... 399/75
5,570,160 A * 10/1996 Miwa et al. ..... 399/116
7,596,342 B2 9/2009 Yasumoto

FOREIGN PATENT DOCUMENTS

JP 04027961 A 1/1992
JP 7-140744 A 6/1995
JP 08054047 A 2/1996
JP 11-101308 A 4/1999
JP 2002-174932 A 6/2002
JP 2003036007 A 2/2003
JP 2003145903 A 5/2003
JP 2005-240938 A 9/2005
JP 2007-333058 A 12/2007
JP 2010-102247 A 5/2010

OTHER PUBLICATIONS

Machine Translation of JP 2003-036007 A obtained on Nov. 4, 2013.*
Office Action from Japanese Patent Office dated Nov. 21, 2012, issued in corresponding Japanese Appln. No. 2010-278415, with English-language translation.
Office Action from Japanese Office Action dated Nov. 21, 2012, issued in corresponding Japanese Appln. No. 2010-281646, with English-language translation.

* cited by examiner

*Primary Examiner* — Gregory H Curran
(74) *Attorney, Agent, or Firm* — Buchanan Ingersoll & Rooney PC

(57) ABSTRACT

An image forming apparatus includes a driving source, a first rotator, a first power transmission system, at least one second rotator, a second power transmission system, and a damper. The driving source generates power. The first rotator is drivingly rotated by the power generated by the driving source. The first power transmission system transmits the power from the driving source to the first rotator. The second rotator is further downstream than the first rotator in a flow of power transmission. The second power transmission system transmits the power from at least one of the first power transmission system and the first rotator to the at least one second rotator. The damper attenuates oscillation between the first power transmission system and the second power transmission system or between the first rotator and the second power transmission system.

12 Claims, 9 Drawing Sheets

IMAGE FORMING APPARATUS

CROSS-REFERENCE TO RELATED APPLICATIONS

The present application claims priority under 35 U.S.C. §119 to Japanese Patent Application No. 2010-281646, filed Dec. 17, 2010. The contents of this application are incorporated herein by reference in their entirety.

BACKGROUND OF THE INVENTION

1. Field of the Invention

The present invention relates to an image forming apparatus.

2. Discussion of the Background

Electrographic image forming apparatuses obtain images by forming an electrostatic latent image on the surface of a rotating photoreceptor, visualizing the electrostatic latent image into a toner image on a developer, and electrostatically transferring the toner image onto a recording medium.

Japanese Unexamined Patent Application Publication No. 1995-140744 discloses an electrographic image forming apparatus of this kind. In the electrographic image forming apparatus, the photoreceptor, the charger, the developer, the cleaner, and other consumables subject to wear through repeated image forming operations are integrated into what is called a process cartridge, which is removable and exchangeable.

SUMMARY OF THE INVENTION

According to one aspect of the present invention, an image forming apparatus includes a driving source, a first rotator, a first power transmission system, at least one second rotator, a second power transmission system, and a damper. The driving source is configured to generate power. The first rotator is configured to be drivingly rotated by the power generated by the driving source. The first power transmission system is configured to transmit the power from the driving source to the first rotator. The second rotator is further downstream than the first rotator in a flow of power transmission. The second power transmission system is configured to transmit the power from at least one of the first power transmission system and the first rotator to the at least one second rotator. The damper is configured to attenuate oscillation between the first power transmission system and the second power transmission system or between the first rotator and the second power transmission system.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
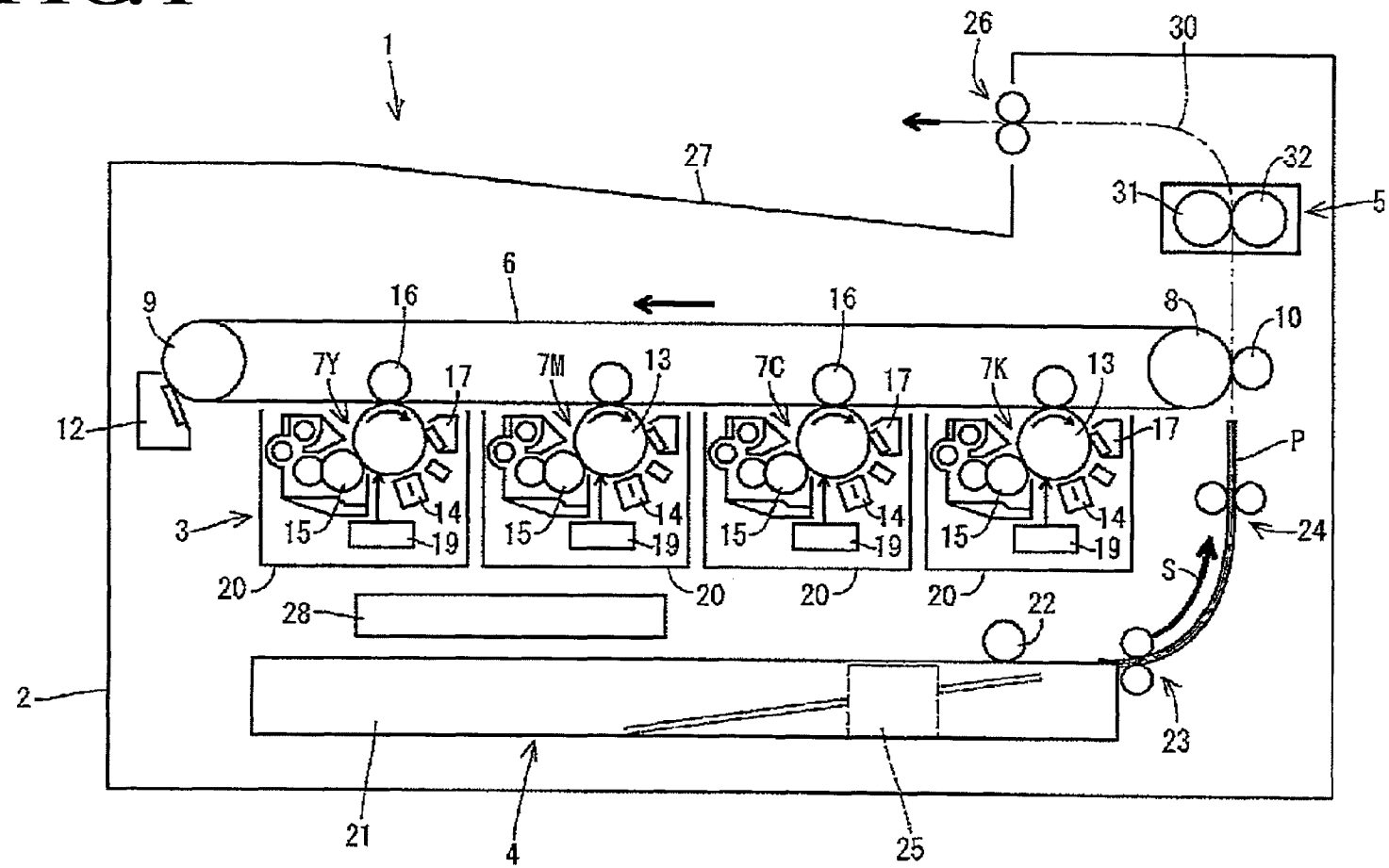
FIG. 1 is a schematic explanatory view of a printer.

The embodiments will now be described with reference to the accompanying drawings, wherein like reference numerals designate corresponding or identical elements throughout the various drawings.

In the following embodiments, a tandem color digital printer (hereinafter referred to as a printer) will be described for exemplary purposes. In the following description, terms indicating specific directions and positions (for example, "left and right" and "upper and lower") are used where necessary. In this respect, the direction perpendicular to the paper plane of FIG. 1 is defined as front view. The terms are used for the sake of description and will not limit the technical scope of the present invention.

1. Overview of Printer

An overview of a printer 1 is first described by referring to FIG. 1. As shown in FIG. 1, the printer 1 includes, in a casing 2, an image processor 3, a sheet feeder 4, and a fixing device 5. The printer 1 is coupled to a network such as a LAN so that upon receipt of a print command from an external terminal (not shown), the printer 1 executes printing based on the command, which is not elaborated in the drawings.

The sheet feeder 4 is positioned at a lower portion of the casing 2 and includes a sheet feed cassette 21, a pickup roller 22, a pair of separation rollers 23, and a pair of timing rollers 24. The sheet feed cassette 21 accommodates recording media P. The pickup roller 22 picks up an uppermost part of the recording media P in the sheet feed cassette 21. The pair of separation rollers 23 separate the picked part of recording media P into individual sheets. The pair of timing rollers 24 transfer the individual sheets of recording medium P, one by one, to the image processor 3 at a predetermined timing. The recording media P in the sheet feed cassette 21 are sent to a conveyance path 30 one at a time from the top by the rotation of the pickup roller 22 and the separation rollers 23. The conveyance path 30 extends from the sheet feed cassette 21 of the sheet feeder 4 though a nip portion between the pair of timing rollers 24, a secondary transfer nip portion 11 of the image processor 3, and a fixing nip portion of the fixing device 5, to reach discharging rollers 26 at an upper portion of the casing 2.

In the sheet feed cassette 21, the recording media P are at a center reference on the sheet feed cassette 21 for conveyance toward the conveyance path 30 in the direction of arrow S. In this respect, the center of each recording medium P in its width direction (which is orthogonal to the transfer direction S) is used as a reference relative to the center reference. In this embodiment, the sheet feed cassette 21 includes a pair of side regulation plates 25 to hold unpicked recording media P across the width thereof so as to align the recording media P with the center reference. The pair of side regulation plates 25 simultaneously move close to or away from one another in the sheet width direction (which is orthogonal to the transfer direction S). In the sheet feed cassette 21, the pair of side regulation plates 25 hold both sides of the recording medium P in the sheet width direction. This ensures that recording media P of any standard are set at the center reference in the sheet feed cassette 21. Accordingly, the transfer process at the image processor 3 and the fixing process at the fixing device 5 are executed based on the center reference.

The image processor 3 is above the sheet feeder 4 and transfers toner images on photoreceptors 13, which are exemplary image carriers, to a recording medium P. The image processor 3 includes an intermediate transfer belt 6 and a total of four image forming units 7 respectively corresponding to colors of yellow (Y), magenta (M), cyan (C), and black (K). The intermediate transfer belt 6, which is another exemplary image carrier, is wound across a driving roller 8 and a driven roller 9 respectively disposed on right and left sides at a vertically central position of the casing 2. A secondary transfer roller 10 is disposed on the outer peripheral side of a portion of the intermediate transfer belt 6 wound around the driving roller 8. The intermediate transfer belt 6 and the secondary transfer roller 10 define, at the portion of their contact, a secondary transfer nip portion 11 as a secondary transfer region. A transfer belt cleaner 12 is disposed on the outer peripheral side of a portion of the intermediate transfer belt 6 wound around the driven roller 9. The transfer belt cleaner 12 removes un-transferred toner remaining on the intermediate transfer belt 6. The casing 2 includes a controller 28 in charge of overall control of the printer 1 between the image processor 3 and the sheet feed device 4. The controller 28 incorporates another controller (not shown) in charge of various arithmetic operations, storing, and control.

Below and along the intermediate transfer belt 6, the four image forming units 7 of yellow (Y), magenta (M), cyan (C), and black (K) are arranged in this order starting on the left side of FIG. 1. For the sake of description, in FIG. 1, the image forming units 7 are respectively labeled with symbols Y, M, C, and K in accordance with reproduced colors. Each image forming unit 7 includes a photoreceptor 13. Around the photoreceptor 13, a charger 14, an exposing unit 19, a developer 15, a primary transfer roller 16, and a photoreceptor cleaner 17 are arranged in this order in the clockwise rotational direction of FIG. 1.

In each of the image forming units 7, the exposing unit 19 radiates a laser beam to the photoreceptor 13 charged by the charger 14, thus forming an electrostatic latent image. The electrostatic latent image is reverse developed using toner supplied from the developer 15 into a toner image of a corresponding color. At primary transfer nip portions, the toner images of yellow, magenta, cyan, and black are primary transferred in this order on the outer circumferential surface of the intermediate transfer belt 6 from the photoreceptors 13, and superimposed one on top of each other. Un-transferred toner remaining on the photoreceptors 13 is scraped off the photoreceptors 13 by the respective photoreceptor cleaners 17. The superimposed toner images of the four colors are collectively secondary transferred on the recording medium P through the secondary transfer nip portion 11. Un-transferred toner remaining on the intermediate transfer belt 6 is scrapped off the intermediate transfer belt 6 by the transfer belt cleaner 12.

The fixing device 5 is positioned above the secondary transfer roller 10 of the image processor 3, and includes a fixing roller 31 and a pressure roller 32. The fixing roller 31 incorporates a heat source such as a halogen heater. The pressure roller 32 is opposite the fixing roller 31. The fixing roller 31 and the pressure roller 32 define, at the portion of their contact, a fixing nip portion as a fixing region. The recording medium P past the secondary transfer nip portion 11 and loaded with an unfixed toner image is heated and pressed through the fixing nip portion between the fixing roller 31 and the pressure roller 32. Thus, the unfixed toner image is fixed on the recording medium P. Then, the recording medium P is discharged on a collection tray 27 by the rotation of the pair of discharging rollers 26.

For example, the developer 15 of each image forming unit 7, the intermediate transfer belt 6, and the transfer belt cleaner 12 are consumables subject to wear through repeated image forming operations. The consumables are exchangeably (removably) disposed in the casing 2. For example, each image forming unit 7 (the photoreceptor 13, the charger 14, the exposing unit 19, the developer 15, and the photoreceptor cleaner 17) is incorporated in a housing 20 in the form of a cartridge (integrated structure) and is exchangeably disposed in the casing 2 as what is called a process cartridge.

Figure 2:
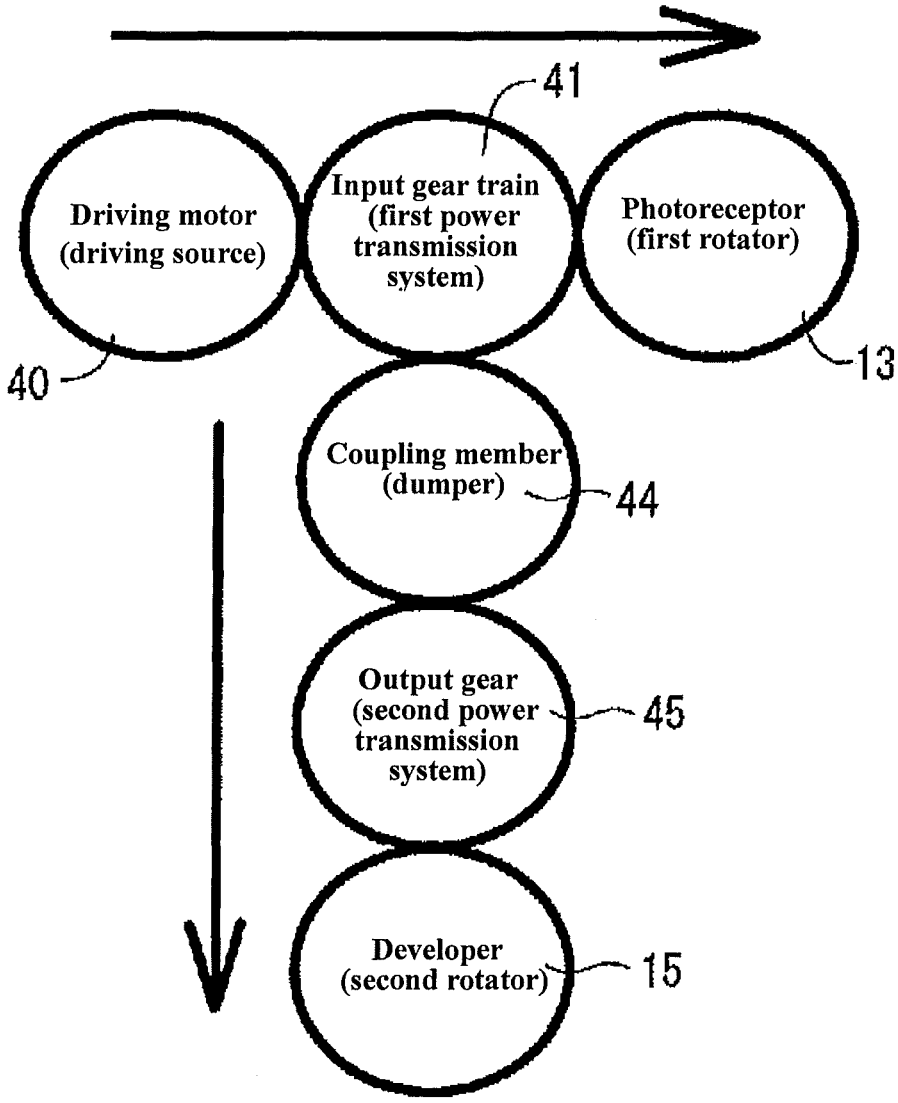
FIG. 2 is a schematic explanatory view of a power transmission system of an image forming unit according to a first embodiment.

2. First Embodiment of Power Transmission Structure, Directed to Image Forming Unit Referring to FIGS. 2 to 5, a first embodiment of a power transmission structure in the image forming unit 7 will be described below. The printer 1 includes, on a side of the casing 2, a driving motor 40 serving as a driving source to generate power. In the first embodiment, the power generated by the driving motor 40 is branched into two directions, namely, to the photoreceptor 13 serving as a first rotator and to the developer 15 serving as a second rotator (see FIG. 2).

In this case, the power generated by the driving motor 40 is first transmitted to an input gear train 41 serving as a first power transmission system. The input gear train 41 includes an input gear 42 and an input relay gear 43. The input gear 42 receives the power from the driving motor 40. The input relay gear 43 meshes with the input gear 42 on the outer circumference. The input relay gear 43 is secured to a rotary shaft 13*a* of the photoreceptor 13 (see FIG. 3 and FIG. 4). This makes the photoreceptor 13 integrally rotate with the input relay gear 43.

A coupling member 44 serving as a damper to attenuate oscillation is power transmittably coupled to a portion of the rotary shaft 13*a* of the photoreceptor 13 away from the photoreceptor 13 over the input relay gear 43 (that is, a distal end of the rotary shaft 13*a* protruding beyond the input relay gear 43). The coupling member 44 (male fitting 47 described later) has outer teeth on the outer circumference, and an output gear 45 serving as a second power transmission system meshes with the teeth. The power transmitted to the output gear 45 is transmitted to the developer 15. That is, part of the power generated by the driving motor 40 is transmitted to the photoreceptor 13 through the input gear train 41. The rest of the power is transmitted from the input gear train 41 to the developer 15 through the coupling member 44 and the output gear 45.

Figure 3:
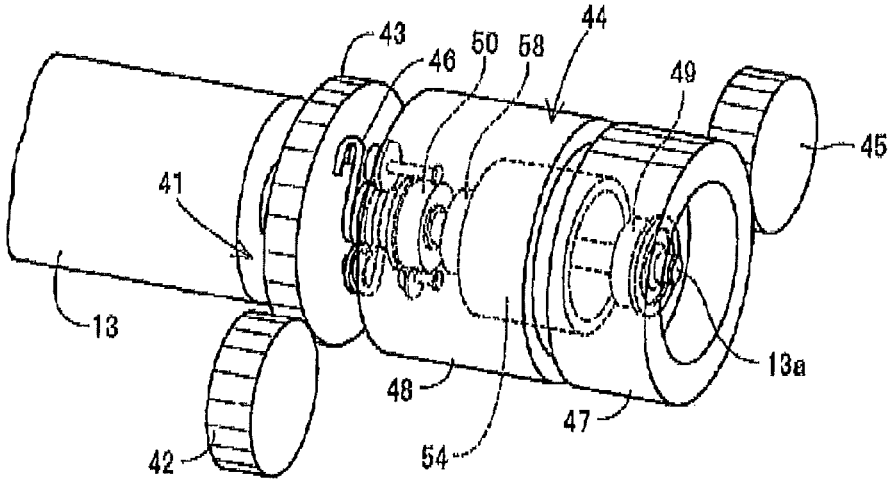
FIG. 3 is a perspective view of the power transmission system of the image forming unit.
Figure 4:
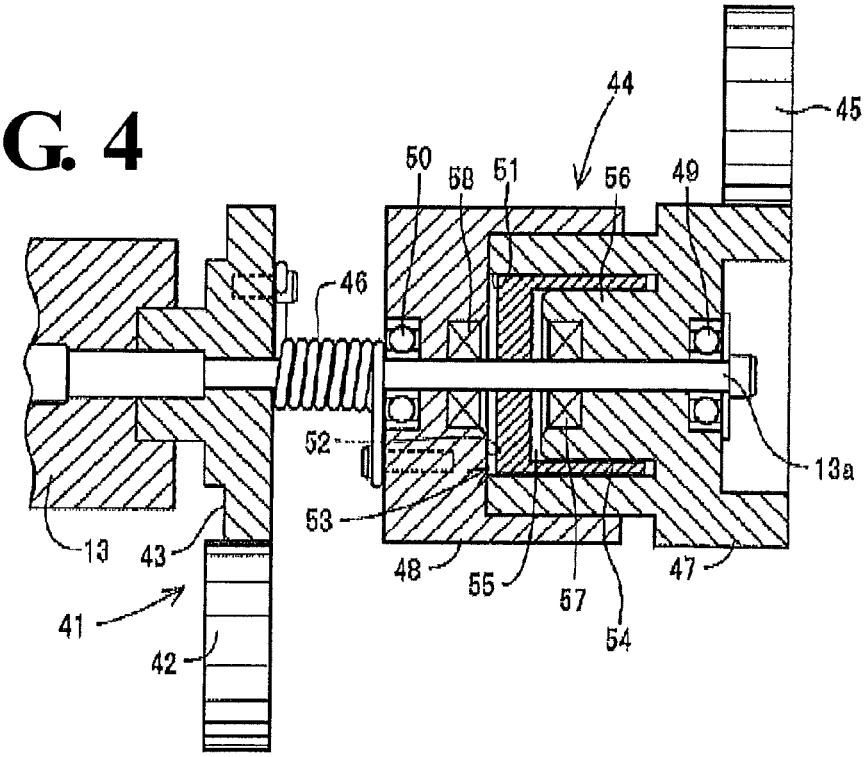
FIG. 4 is a cross-sectional explanatory view of FIG. 3.

As shown in FIG. 3 and FIG. 4, a linkage spring 46 serving as an elastic body is fitted on a portion of the rotary shaft 13*a* of the photoreceptor 13 between the input relay gear 43 and the coupling member 44. The linkage spring 46 is engaged with the input relay gear 43 at one end and with the coupling member 44 (female fitting 48, described later) at the other end. That is, the coupling member 44 receives the rotary power transmitted to the input relay gear 43 utilizing the elastic restoring force of the linkage spring 46.

As shown in FIG. 4, the coupling member 44 includes a male fitting 47 and a female fitting 48 fitted with one another. The rotary shaft 13*a* penetrates through the male and female fittings 47 and 48 in the direction in which the male and female fittings 47 and 48 are fitted with one another, so as to rotatably support the male and female fittings 47 and 48 respectively via shaft bearings 49 and 50. The male fitting 47 has a recess 51 on the side fitted with the female fitting 48. The male and female fittings 47 and 48 are fitted with one another by press fitting or other means that makes them difficult to fall apart. With the male and female fittings 47 and 48 fitted with one another, the recess 51 of the male fitting 47 and a bottom inner surface 52 of the female fitting 48 define a hollow space 53 in the coupling member 44. The space 53 in the coupling member 44 incorporates, together with a viscous fluid 55, a rotating resistor 54 to rotate integrally with the rotary shaft 13*a* of the photoreceptor 13.

The viscous fluid 55 provides a viscous resistance (rotation resistance) to the rotating resistor 54 when the rotating resistor 54 integrally rotates with the rotary shaft 13*a* of the photoreceptor 13. This effects a relative rotation between the rotating resistor 54 and the coupling member 44 (that is, a rotation delay of the coupling member 44 results). The viscous resistance is obtained in association with shear resistance and agitation resistance of the viscous fluid 55. The viscous fluid 55 is not limited to a particular type. Examples include, but not limited to, grease and a highly viscous fluid such as silicone oil.

In the first embodiment, the rotating resistor 54 has a cylindrical shape with one end open. In the recess 51, the male fitting 47 has a cylindrical protrusion 56 fitted with the opening on the one end of the rotating resistor 54. The rotating resistor 54 covers the cylindrical protrusion 56 in the recess 51 of the male fitting 47. A slight gap exists between the outer circumferential surface of the cylindrical protrusion 56 and the inner circumferential surface of the rotation resistance 54. Similarly, a slight gap exists between the outer circumferential surface of the rotation resistance 54 and the inner circumferential surface of the recess 51 of the male fitting 47. The viscous fluid 55 fills the gaps. An oil seal 57 to prevent leakage of the inner viscous fluid 55 is disposed at a portion of the cylindrical protrusion 56 of the male fitting 47 where the rotary shat 13*a* penetrates. Similarly, an oil seal 58 to prevent leakage of the inner viscous fluid 55 is disposed at a portion of the bottom inner surface 52 of the female fitting 48 where the rotary shat 13*a* penetrates.

With the above-described configuration, the branched power past the input relay gear 43 is first transmitted to the rotating resistor 54 in the coupling member 44 through the rotary shaft 13*a*. The rotating resistor 54 receives the viscous resistance of the viscous fluid 55 while integrally rotating with the rotary shaft 13*a*. This effects a relative rotation between the rotating resistor 54 and the coupling member 44 (that is, a rotation delay of the coupling member 44 results). That is, the viscous fluid 55 attenuates oscillations resulting from, for example, varying rotation rates of the driving motor 40 and varying loads on the developer 15. The coupling member 44 receives the rotary power transmitted to the input relay gear 43 utilizing the elastic restoring force of the linkage spring 46. This, as a result, significantly reduces varying rotation rates of the photoreceptor 13 and minimizes image blurring (banding), thereby improving image quality. It is particularly noted that the image forming unit 7 exchangeably disposed in the casing 2 in the form of what is called a process cartridge, which additionally advantageously simplifies the power transmission system and reduces size and weight of the power transmission system.

Figure 5:
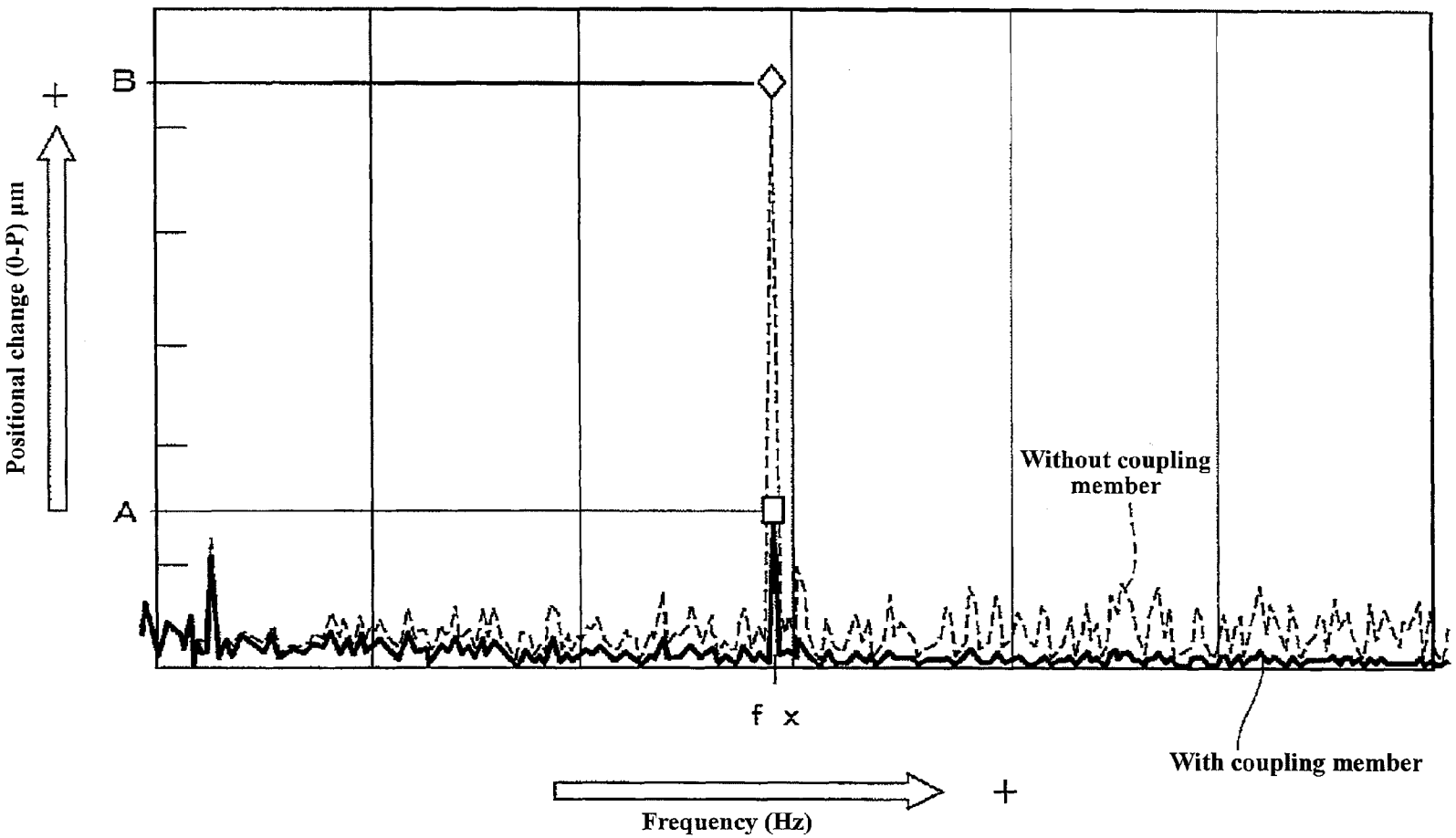
FIG. 5 is a graph showing how a coupling member influences varying rotation rates of a photoreceptor.

FIG. 5 shows results of an experiment on how the coupling member 44 influences varying rotation rates of the photoreceptor 13. The graph of FIG. 5 shows frequencies on the horizontal axis and 0-P values of positional change (zero-peak values, which is the maximum positional changes) on the vertical axis. The positional change values are obtained in the following manner. The surface of the photoreceptor 13 is irradiated with a laser beam of a laser Doppler to measure the rotation rate of the photoreceptor 13. Variations in rotation rate of the photoreceptor 13 are converted into the positional change values. In the case without the coupling member 44, the input relay gear 43 meshes with the output gear 45.

As shown in FIG. 5, the zero-peak value A relative to the frequency fx in the case with the coupling member 44 is one-fourth of the zero-peak value B relative to the frequency fx in the case without the coupling member 44. This proves that the presence of the coupling member 44 appropriately reduces the influence that varying rotation rates of the photoreceptor 13 have on the image forming operation, thereby ensuring high image quality.

Figure 6:
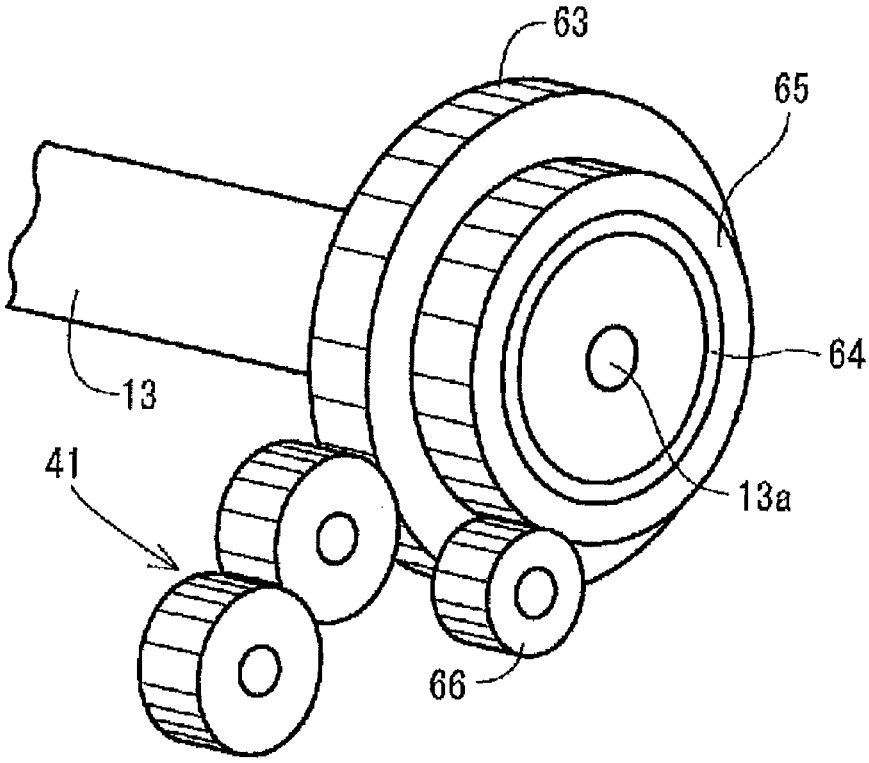
FIG. 6 is a perspective view of a power transmission system of the image forming unit according to a second embodiment.

3. Second Embodiment of Power Transmission Structure, Directed to Image Forming Unit Referring to FIG. 6, a second embodiment of the power transmission structure, which is directed to the image forming unit 7, will be described. In the second embodiment, a photoreceptor gear 63, which is a component of the first power transmission system, is secured to the rotary shaft 13*a* of the photoreceptor 13. The input gear train 41 meshes with the photoreceptor gear 63 to transmit power to the photoreceptor gear 63. An output gear 65 is a component of the second power transmission system and is unremovably secured to a protruding end of the photoreceptor gear 63 on the side opposite the photoreceptor 13. A viscoelastic body 64 serving as a damper to attenuate oscillations is disposed between the protruding end of the photoreceptor gear 63 and the output gear 65. The output gear 65 is power transmittably coupled to the developer 15 through an output relay gear 66. The viscoelastic body 64 may be anti-oscillation rubber such as flexibly and elastically deformable synthesized rubber. Examples include, but not limited to, chloroprene rubber, ethylene propylene rubber, silicone gel, oil impregnated cellular rubber, butyl rubber, and thermoplastic elastomer. The second embodiment is otherwise similar to the first embodiment.

In this configuration, the power generated by the driving motor 40 is branched into two directions, namely, to the photoreceptor 13 and to the developer 15. In this respect, providing the viscoelastic body 64 between the photoreceptor gear 63 and the output gear 65 ensures that the viscoelastic body 64 attenuates oscillations resulting from, for example, varying rotation rates of the driving motor 40 and varying loads on the developer 15. This, as a result, significantly reduces varying rotation rates of the photoreceptor 13 and minimizes image blurring (banding), thereby improving image quality, similarly to the first embodiment.

Figure 7:
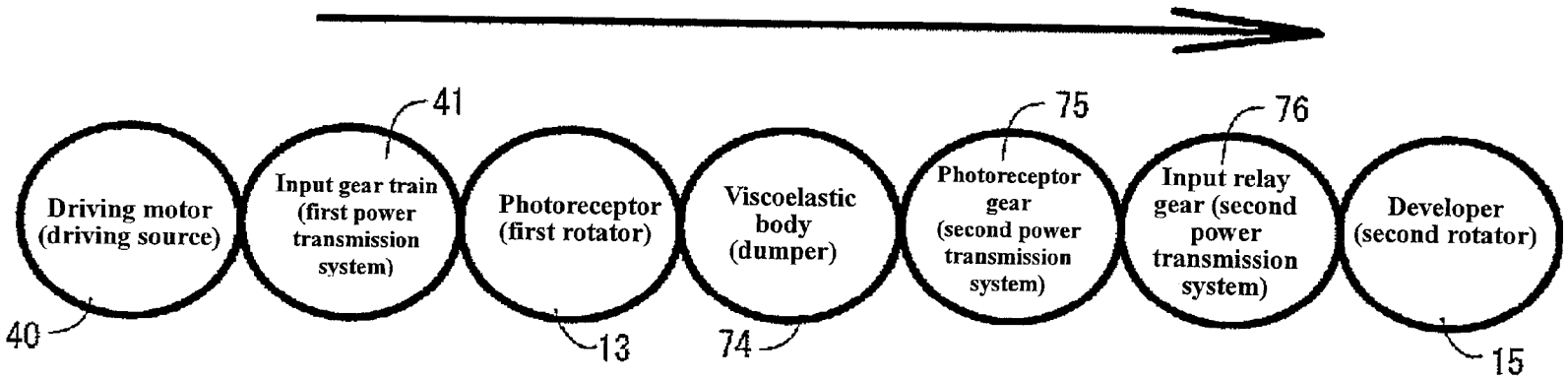
FIG. 7 is a schematic explanatory view of a power transmission system of the image forming unit according to a third embodiment.
Figure 8:
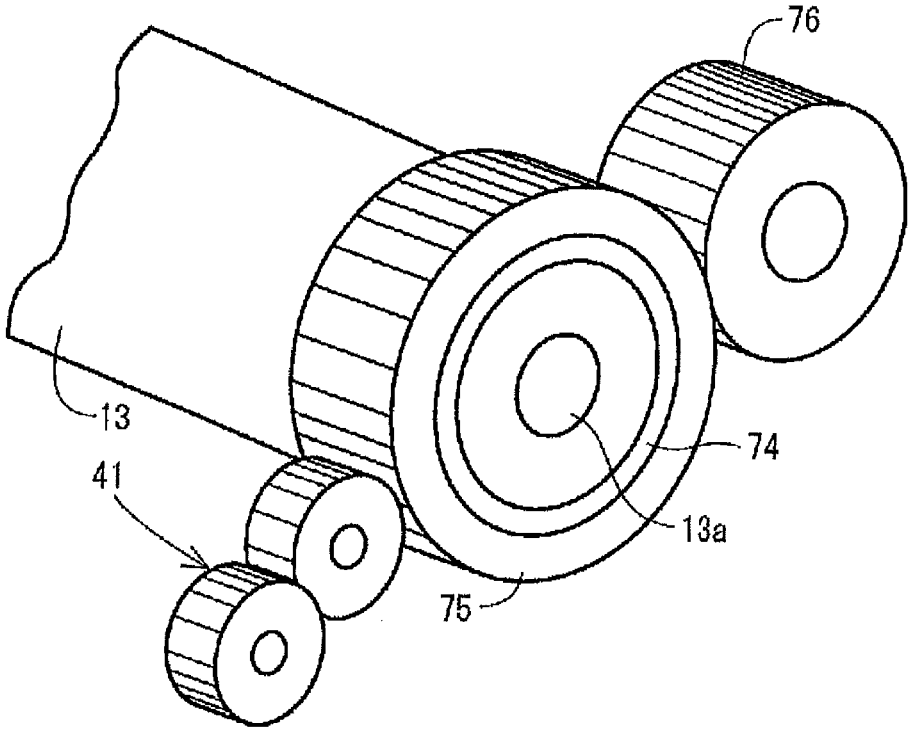
FIG. 8 is a perspective view of a power transmission system of the image forming unit.

4. Third Embodiment of Power Transmission Structure, Directed to Image Forming Unit A third embodiment of the power transmission structure, which is directed to the image forming unit 7, will be described by referring to FIG. 7 and FIG. 8. In the third embodiment, the power generated by the driving motor 40 is transmitted to the photoreceptor 13 and the developer 15 in this order (see FIG. 7). In this case, a photoreceptor gear 75, which is a component of the second power transmission system, is unremovably attached to the rotary shaft 13*a* of the photoreceptor 13. A viscoelastic body 74 serving as a damper to attenuate oscillations is disposed between the photoreceptor gear 75 and the rotary shaft 13*a* of the photoreceptor 13. The input gear train 41 serving as the first power transmission system meshes with the photoreceptor gear 75 to transmit power to the photoreceptor gear 75. The photoreceptor gear 75 is power transmittably coupled to the developer 15 through an input relay gear 76. The viscoelastic body 74 may be similar to the one the second embodiment.

In this configuration, the power generated by the driving motor 40 is transmitted to the photoreceptor 13 and the developer 15 in this order. In this respect, providing the viscoelastic body 74 between the photoreceptor 13 and the photoreceptor gear 75 ensures that the viscoelastic body 74 attenuates oscillations resulting from, for example, varying rotation rates of the driving motor 40 and varying loads on the developer 15. This, as a result, significantly reduces varying rotation rates of the photoreceptor 13 and minimizes image blurring (banding), thereby improving image quality, similarly to the first and the second embodiments.

Figure 9:
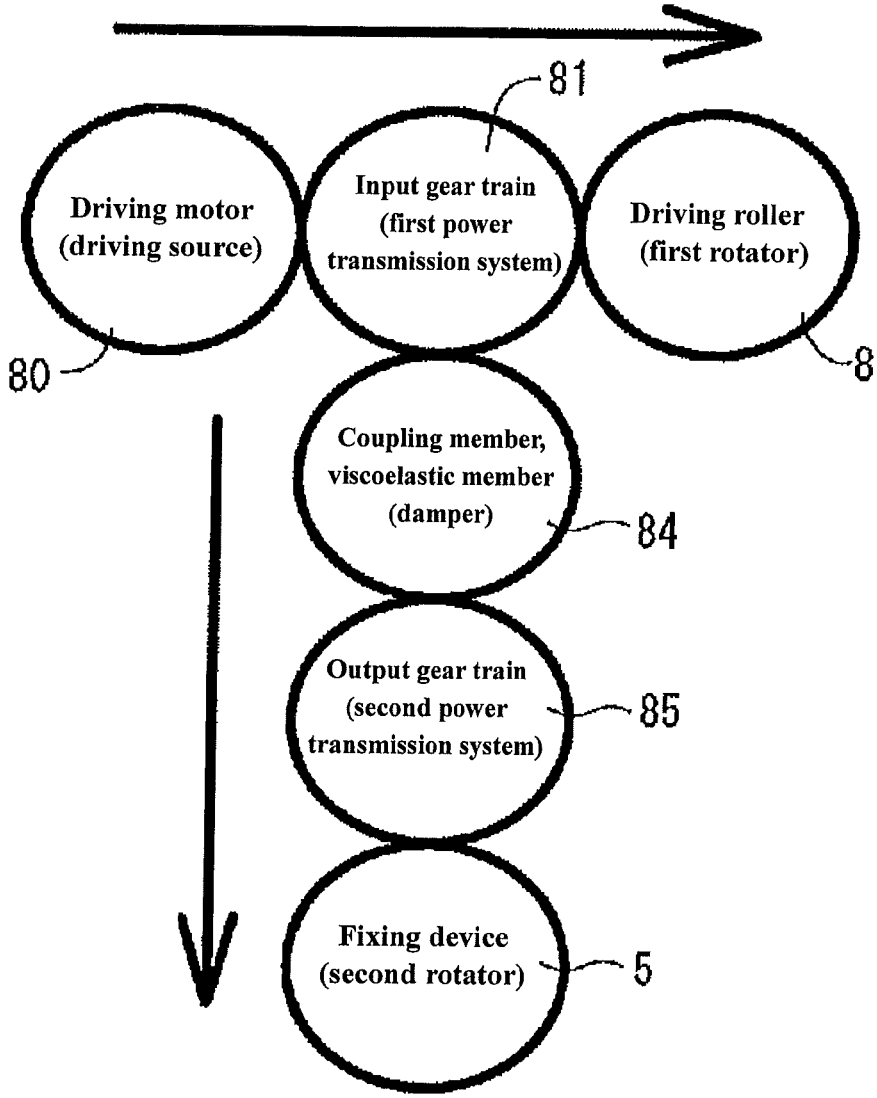
FIG. 9 is a schematic explanatory view of a power transmission system of the image forming unit according to a fourth embodiment.

5. Fourth Embodiment of Power Transmission Structure, Directed to Periphery of Intermediate Transfer Belt A fourth embodiment of the power transmission structure, which is directed to the periphery of the intermediate transfer belt 6, will be described by referring to FIG. 9. In the fourth embodiment, the power generated by a driving motor 80, which is a driving source disposed on a side of the casing 2 of the printer 1, is branched into two directions, namely, to the driving roller 8 serving as the first rotator and to the fixing device 5 (which includes the fixing roller 31 and the pressure roller 32) serving as the second rotator. That is, part of the power generated by the driving motor 80 is transmitted to the driving roller 8 through a first power transmission system 81, which includes an input gear train. The rest of the power is transmitted to the fixing device 5 from the first power transmission system 81 through a damper 84 and a second power transmission system 85. The damper 84 includes a coupling member and a viscoelastic member. The second power transmission system 85 includes an output gear train. The driving roller 8, around which the intermediate transfer belt 6 is wound, serves as an intermediate transfer.

In this configuration, the damper 84 is disposed between the first power transmission system 81 and the second power transmission system 85. This ensures that the damper 84 attenuates oscillations resulting from, for example, varying rotation rates of the driving motor 80 and varying loads on the fixing device 5. This significantly reduces varying rotation rates of the driving roller 8, around which the intermediate transfer belt 6 is wound, and minimizes image blurring (banding), thereby improving image quality, similarly to the first to third embodiments.

Figure 10:
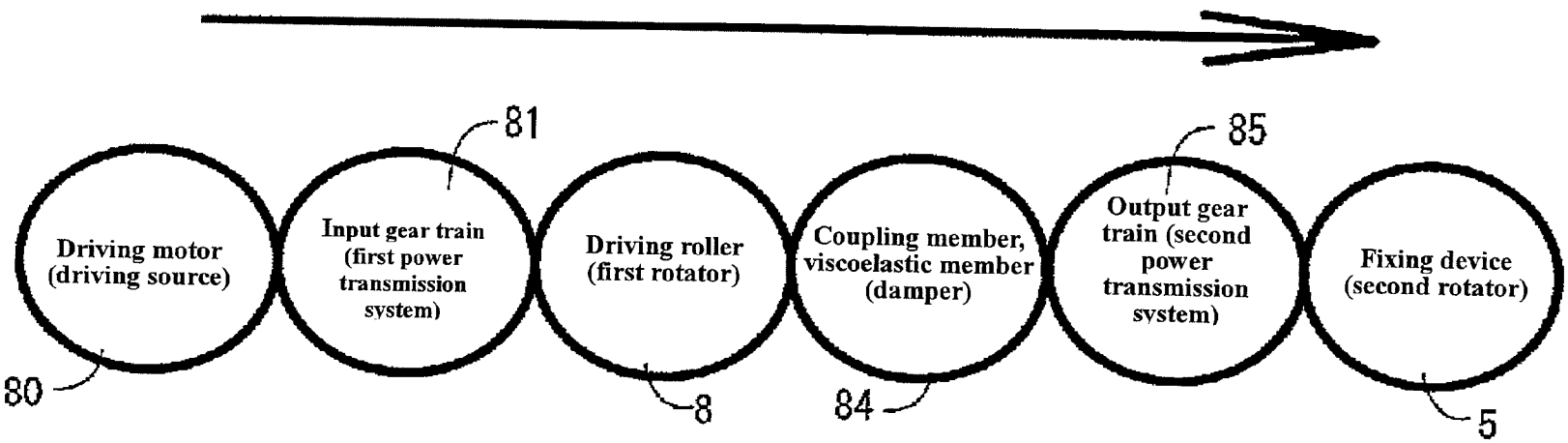
FIG. 10 is a schematic explanatory view of a power transmission system of an image forming unit according to a fifth embodiment.

6. Fifth Embodiment of Power Transmission Structure, Directed to Periphery of Intermediate Transfer Belt A fifth embodiment of the power transmission structure, which is directed to the periphery of the intermediate transfer belt 6, will be described by referring to FIG. 10. In the fifth embodiment, the power generated by the driving motor 80 is transmitted to the driving roller 8 and the fixing device 5 in this order. Specifically, the power generated by the driving motor 80 is transmitted to the driving roller 8 through the first power transmission system 81, which includes the input gear train. The power transmitted to the secondary transfer roller 10 is transmitted to the fixing device 5 through the damper 84 and the second power transmission system 85. The damper 84 includes the coupling member and the viscoelastic body. The second power transmission system 85 includes the output gear train. In this configuration, the damper 84 is disposed between the driving roller 8 and the second power transmission system 85. This ensures that the damper 84 attenuates oscillations resulting from, for example, varying rotation rates of the driving motor 80 and varying loads on the fixing device 5. This significantly reduces varying rotation rates of the driving roller 8 and minimizes image blurring (banding), thereby improving image quality, similarly to the first to fourth embodiments.

7. Other Notes

It will be appreciated that the present invention will not be limited to the embodiments described above and can be embodied in various other forms. For example, while a printer has been described as an exemplary image forming apparatus, this should not be construed in a limiting sense. Other possible examples include copiers, fax machines, and multifunction machines integrally incorporating copy and fax capabilities. Also the second rotator may include a plurality of rotators. For example, in the fourth and the fifth embodiments, the sheet feed device 4 may serve as a third rotator and be disposed further downstream than the driving roller 8, which serves as the first rotator, in the flow of power transmission. In this case, the power transmission structure relative to the other rotators preferably includes a power transmission system and a damper between the third rotator and the other rotators. Moreover, the location or arrangement of individual elements in the illustrated embodiments should not be construed in a limiting sense. Various modifications can be made without departing from the scope of the present invention.

In the embodiments, a damper to attenuate oscillations is disposed between the second power transmission system, which transmits power to the second rotator, and one of the first rotator and the first power transmission system, which transmits the power from the driving source to the first rotator. This ensures that the damper attenuates oscillations resulting from, for example, varying rotation rates of the driving source and varying loads on the second rotator. This, as a result, significantly reduces varying rotation rates of the first rotator and minimizes image blurring (banding), thereby improving image quality.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus comprising:

a driving source configured to generate power;

a first rotator configured to be drivingly rotated by the power generated by the driving source;

a first power transmission system configured to transmit the power from the driving source to the first rotator;

at least one second rotator further downstream than the first rotator in a flow of power transmission;

a second power transmission system configured to transmit the power from at least one of the first power transmission system and the first rotator to the at least one second rotator; and a damper configured to attenuate oscillation between the first power transmission system and the second power transmission system or between the first rotator and the second power transmission system, wherein the damper comprises a coupling member incorporating a viscous fluid in a space of the coupling member, the viscous fluid being configured to provide a resistance against rotation of the coupling member, the coupling member is rotatably supported by a rotary shaft of the first rotator, and a rotating resistor configured to rotate integrally with the rotary shaft is incorporated in the space of the coupling member together with the viscous fluid.

2. The image forming apparatus according to claim 1, wherein the coupling member comprises a male fitting and a female fitting fitted with one another, wherein the rotary shaft of the first rotator penetrates through the male fitting and the female fitting in a direction in which the male fitting and the female fitting are fitted with one another, so as to rotatably support the male fitting and the female fitting, wherein the first power transmission system is coupled to at least one of the male fitting and the female fitting through an elastic body, and wherein the male fitting has a recess and the female fitting has a bottom inner surface, the recess and the bottom inner surface defining the space to incorporate the rotating resistor together with the viscous fluid.

3. The image forming apparatus according to claim 1, wherein the damper comprises a viscoelastic body configured to couple the second power transmission system to at least one of the first power transmission system and the first rotator so as to drivingly rotate the second power transmission system in conjunction with at least one of the first power transmission system and the first rotator.

4. The image forming apparatus according to claim 1, wherein the first rotator comprises at least one of a photoreceptor and an intermediate transfer each configured to carry an image.

5. The image forming apparatus according to claim 1, wherein the at least one second rotator comprises a plurality of rotators.

6. The image forming apparatus according to claim 1, wherein the first rotator comprises at least one of a photoreceptor and an intermediate transfer each configured to carry an image, and wherein the at least one second rotator comprises a plurality of rotators.

7. The image forming apparatus according to claim 2, wherein the first rotator comprises at least one of a photoreceptor and an intermediate transfer each configured to carry an image.

8. The image forming apparatus according to claim 3, wherein the first rotator comprises at least one of a photoreceptor and an intermediate transfer each configured to carry an image.

9. The image forming apparatus according to claim 2, wherein the at least one second rotator comprises a plurality of rotators.

10. The image forming apparatus according to claim 3, wherein the at least one second rotator comprises a plurality of rotators.

11. The image forming apparatus according to claim 2, wherein the first rotator comprises at least one of a photoreceptor and an intermediate transfer each configured to carry an image, and wherein the at least one second rotator comprises a plurality of rotators.

12. The image forming apparatus according to claim 3, wherein the first rotator comprises at least one of a photoreceptor and an intermediate transfer each configured to carry an image, and wherein the at least one second rotator comprises a plurality of rotators.

* * * * *